US008177565B2

(12) United States Patent
Bowen

(10) Patent No.: US 8,177,565 B2
(45) Date of Patent: May 15, 2012

(54) ELECTRICAL CONNECTION APPARATUS WITH MOVABLE PARTS

(75) Inventor: David Bowen, Dewsbury (GB)

(73) Assignee: Logicor Limited, Wakefield (GB)

( * ) Notice: Subject to any disclaimer, the term of this patent is extended or adjusted under 35 U.S.C. 154(b) by 0 days.

(21) Appl. No.: 12/442,479

(22) PCT Filed: Oct. 5, 2007

(86) PCT No.: PCT/GB2007/003786

§ 371 (c)(1),
(2), (4) Date: May 5, 2009

(87) PCT Pub. No.: WO2008/043986

PCT Pub. Date: Apr. 17, 2008

(65) Prior Publication Data

US 2010/0022109 A1 Jan. 28, 2010

(30) Foreign Application Priority Data

Oct. 10, 2006 (GB) ..... 0619982.2

(51) Int. Cl.
*H01R 13/44* (2006.01)

(52) U.S. Cl. ..... 439/134

(58) Field of Classification Search ..... 439/134, 439/152, 156; 200/51 R; 307/141
See application file for complete search history.

(56) References Cited

U.S. PATENT DOCUMENTS 1,942,040 A * 1/1934 Wolff ..... 188/298
3,126,459 A * 3/1964 Leeson ..... 200/39 R
3,475,715 A * 10/1969 Venaleck ..... 439/159
4,136,918 A * 1/1979 Claesson et al. ..... 439/172
4,712,019 A * 12/1987 Nilssen ..... 307/141
4,820,176 A * 4/1989 Niikura ..... 439/152
5,393,237 A 2/1995 Roy et al.

FOREIGN PATENT DOCUMENTS

GB 432053 A 7/1935
GB 2417141 A 2/2006
WO WO 2006/016119 A2 2/2006
WO WO 2008/043986 A1 4/2008

OTHER PUBLICATIONS

International Search Report for PCT/GB2007/003786, completed Feb. 18, 2008.

International Preliminary Report on Patentability for PCT/GB2007/003786, issued Apr. 15, 2009.

Written Opinion of the International Searching Authority for PCT/GB2007/003786, completed Feb. 18, 2008, mailed Feb. 27, 2008.

* cited by examiner

*Primary Examiner* — Tulsidas C Patel
*Assistant Examiner* — Phuongchi Nguyen
(74) *Attorney, Agent, or Firm* — Clark & Elbing LLP

(57) ABSTRACT

The invention features an electrical connection apparatus capable of operatively attaching to an electrical appliance or electrical socket. The apparatus also includes at least two electrical connections which can communicate with each other to allow the flow of electrical charge therebetween. The apparatus can also be arranged to allow relative movement of the at least first and/or second electrical connection between a first position, wherein electrical charge can flow therebetween, and a second position, wherein the flow of electrical charge is prevented. The relative movement can take place over a pre-determined time period following actuation to provide a timing mechanism for the apparatus.

19 Claims, 2 Drawing Sheets

ELECTRICAL CONNECTION APPARATUS WITH MOVABLE PARTS

CROSS-REFERENCE TO RELATED APPLICATIONS

This application is the U.S. National Stage of International Application No. PCT/GB2007/003786, filed Oct. 5, 2007, which, in turn, claims the benefit of British Patent Application No. GB 0619982.2, filed Oct. 10, 2006, each of which is herein incorporated by reference.

This invention relates to electrical connection apparatus and a method of use thereof.

Although the following description refers almost exclusively to electrical connection apparatus in the form of a three pin electrical plug of a type commonly used in the United Kingdom, it will be appreciated by persons skilled in the art that the present invention can relate to any type of electrical plug, such as a two pin plug, or indeed any type of electrical plug or connection which is located in a complementary socket or connection to allow the flow of electrical charge between the plug and socket or complementary connections.

Conventionally if a user wishes to use an electrical appliance, such as for example an iron, the user places the plug, typically attached to the iron at the end of an electrical cable running between the iron housing and the plug, in a wall electrical socket. The user then actuates a switch associated with the wall socket to allow electrical current to pass from a mains power supply, through the wall socket, along the plug pins to electrical connections internally of the plug and along the electrical cable to the iron. A further operational switch may be associated with the iron to allow the electrical current being passed along the electrical cable to make contact with electrical connections in the iron if required. Once the user has finished with the iron, the user may switch the iron off by operating the iron operational switch, the wall socket switch and/or removing the plug from the wall socket, thereby stopping the flow of electrical current from the mains power supply to the iron.

However, a common problem is that a user may forget to switch the iron or other electrical appliance off after use, particularly if the user is a child or elderly person. This can lead to a waste of electrical power and/or overheating of the appliance, which may result in fire and/or damage to the appliance or locality in which the appliance is located.

In an attempt to overcome this problem, it is known to provide timing devices which automatically switch the electricity supply to an appliance on and/or off after one or more pre-determined time periods. An example of such a timing device typically requires a user to first set the timing device to switch the electrical supply on at a first set time and to switch the electrical supply off at a second set time. This setting may require use of a tool. The timing device is then plugged into a wall socket and the electrical appliance is plugged into the timing device. However, it can be time consuming to set/reset the timing device and the timing device may not be set to function when the user wishes to use the appliance. As such, a user will often not use the timing device. In addition, the combination of a separate timing device and plug makes the arrangement bulky and unsightly.

Other timing devices are also known for use with light switches in, for example, communal areas of a building. Once the light switch is actuated, typically by a user depressing the switch, the light remains in an on position for a pre-determined time period equivalent to the time taken for a movement mechanism associated with the switch to move the switch from an electrically connected position to an electrically disconnected position. However, such timing devices are fixed and are therefore of only limited use.

It is therefore an aim of the present invention to provide electrical connection apparatus, preferably of a type that is detachably attachable to a socket or electrical appliance in normal use or that is portable, which overcomes the abovementioned problems.

It is a further aim of the present invention to provide a method of use of electrical connection apparatus which overcomes the abovementioned problems.

It is a yet further aim of the present invention to provide electrical connection apparatus with a built in timing mechanism.

According to a first aspect of the present invention there is provided electrical connection apparatus, said apparatus including engagement means to allow attachment of the apparatus to an electrical appliance or electrical socket in use and at least first and second electrical connection means which can communicate with each other in use to allow the flow of electrical charge therebetween, and wherein said apparatus further includes movement means arranged to allow relative movement of the at least first and/or second electrical connection means between a first position, wherein electrical charge can flow therebetween, and a second position, wherein the flow of electrical charge is prevented, the relative movement taking place over a pre-determined time period following actuation or on actuation of said movement means, characterized in that the at least first and second electrical connection means are associated with at least first and second parts of the apparatus and said movement means allows relative movement of the at least first and/or second parts in use.

Preferably the engagement means allow detachable attachment of the apparatus to an electrical appliance, plug or socket.

The time taken for relative movement of the electrical connection means between said first and second positions therefore acts as a timing mechanism to allow an electricity supply to be provided for said time period. It is to be noted that the second position can be reached before relative movement of the electrical connection means has stopped.

In one embodiment the at least first and second electrical connection means are engaged or in electrical contact (i.e. sufficiently close to allow an electrical charge to pass therebetween) in the first position and a spaced distance apart (i.e. sufficiently far apart to prevent electrical charge from being passed therebetween) and disengaged in the second position.

Preferably the at least first and second electrical connection means are associated with at least first and second parts of the apparatus respectively.

Further preferably the movement means allows relative movement of the at least first and/or second parts in use.

First and/or second parts and/or electrical connection means typically are arranged to undergo slidable relative movement. This movement is preferably linear movement, such as for example substantially horizontal movement or substantially vertical movement.

The movement means can include any or any combination of pneumatic, mechanical and/or electrical means or mechanism. For example, a rod and piston type arrangement can be provided, a spring (i.e. a compressible spring) and/or the like.

In a preferred embodiment, potential energy stored in the movement means is converted to kinetic energy on actuation of the movement means.

In one embodiment the movement means moves automatically following actuation of the same (i.e. it requires no further user interaction to allow movement of the same). Preferably movement continues to take place for a pre-determined time period after actuation. The pre-determined time period can be any suitable time period, such as seconds, minutes or hours.

In one embodiment the movement means moves automatically after a pre-determined time period has elapsed following actuation thereof.

Preferably adjustment means can be associated with said movement means to allow adjustment of the pre-determined time period taken for the movement means to move the at least first and/or second electrical connection means between said first and second positions.

The adjustment means typically changes the speed of movement of the movement means.

Preferably further electrical connection means are associated with said first and/or second parts.

In one embodiment the further electrical connection means form at least part of the engagement means allowing detachable attachment of the apparatus to a socket or appliance in use. Thus, in one example, at least part of the engagement means allows electrical current to pass therethrough.

The engagement means can include one or more electrical pins, such as a live, neutral and/or earth pin.

In an alternative embodiment, separate engagement means are provided to the further electrical connection means to allow detachable attachment of the electrical connection apparatus to the appliance and/or socket.

Preferably an electrical cable is associated with one of said at least first and second parts. The electrical cable allows an electricity supply to pass along said cable and into one of said parts. Preferably the cable is provided between an electrical appliance and the electrical connection apparatus.

In one embodiment the at least first and second parts form a whole or substantial portion of a housing of the electrical connection apparatus.

Preferably the electrical connection apparatus is in the form of a plug. Further preferably the at least first and second parts of the apparatus form an outer casing or housing of said plug.

The electrical connection apparatus or plug of the present invention can be retrofitted to any existing electrical appliance as required.

Preferably the movement means are actuated by a user forcing the first and second parts and/or electrical connection means together to form the first position.

Thus, in one embodiment at least a portion of the at least first and second parts are provided substantially adjacent to each other or in abutting relationship with each other in the first position, and said portion of the first and second parts is provided a spaced distance apart from each other in the second position.

Preferably the user is required to apply a first force to the first and/or second parts of the apparatus to engage the apparatus to a socket or appliance in use and apply a second force to the first and/or second parts of the apparatus to actuate the movement means. The first and second forces can be applied in any order.

In one embodiment the apparatus is arranged such that the first force is required to be applied in a first direction and the second force is applied in substantially the same direction. In an alternative embodiment the first and second forces are applied in substantially different directions.

User application of the first force to the apparatus can be a separate and distinct action to application of the second force or can be the same substantially continuous force.

Preferably sealing means are associated with said at least first and/or second parts to allow an interior cavity defined by the parts to be substantially sealed in both the first and second positions.

Preferably once the second position has been reached the apparatus is reset by actuating the movement means again. Thus, the timer in one embodiment is typically operable for only a single use prior to require resetting. The movement means can be moved in a reciprocal manner between the first and second positions.

A plurality of different electrical connection apparatus can be provided, each apparatus allowing the flow of electricity therethrough for different times.

Preferably the time taken to separate the electrical connections is relatively slow, thereby allowing a user to perform at least one function via the electrical connection apparatus during movement of the apparatus from the first to the second position. For example, to allow operation of an electrical item associated with the electrical connection apparatus.

The electrical connection apparatus can be in the form of a plug or socket.

According to a second aspect of the present invention there is provided an electrical plug, said electrical plug including at least first and second electrical connection means which can communicate with each other in use to allow the flow of electrical charge therebetween, and wherein said plug further includes movement means arranged to allow relative movement of the at least first and/or second electrical connection means from a first position, wherein electrical charge can flow therebetween, to a second position, wherein the flow of electrical charge is prevented, said relative movement taking place over a predetermined time period following or on actuation of said movement means.

According to further independent aspects of the present invention there is provided a method of using electrical connection apparatus; and an electrical appliance with electrical connection apparatus.

Thus, it can be seen that the present invention provides a simple and inexpensive timing apparatus for electrical connection apparatus, such as a plug. The timing apparatus can be used for any application, such as limiting the amount of time a person (e.g., a child) uses a computer, phone and/or television, preventing overheating of hair tongs, preventing an iron from being left on and/or the like. No additional tools are required to set/reset the apparatus. The electrical connection apparatus is easily portable and is compact in design being of a similar shape and dimensions to a conventional plug or connection.

An embodiment of the present invention will now be described with reference to the accompanying figures, wherein.

Figure 1:
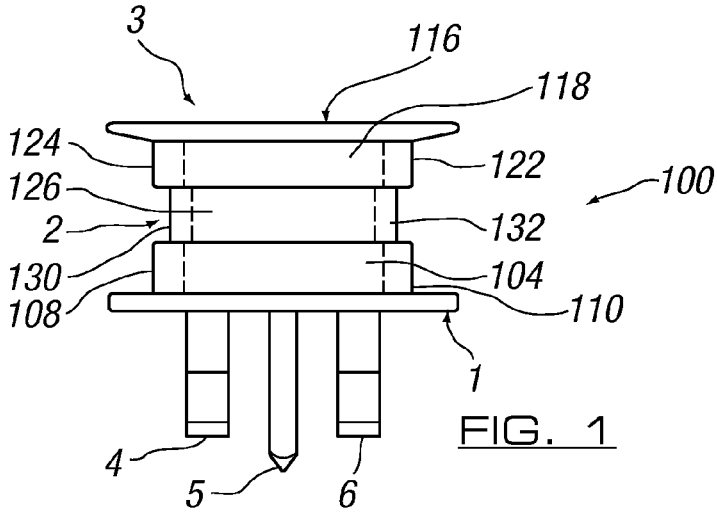
FIGS. 1-4 illustrate a top view, left side view, front view and base view respectively of an electrical plug when in a second disconnected position.
Figure 2:
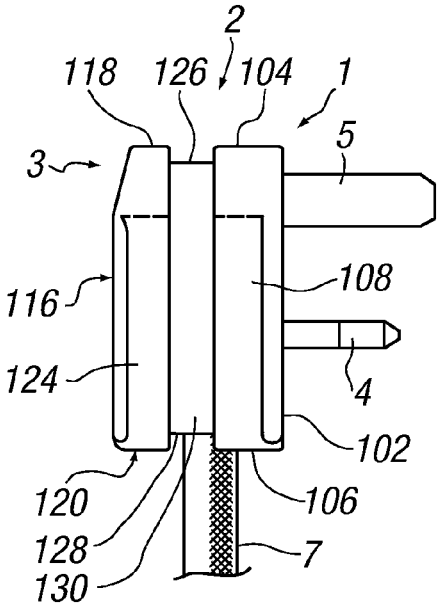
Figure 3:
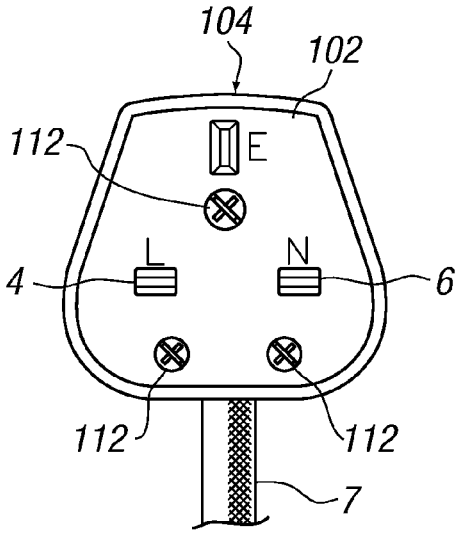
Figure 4:
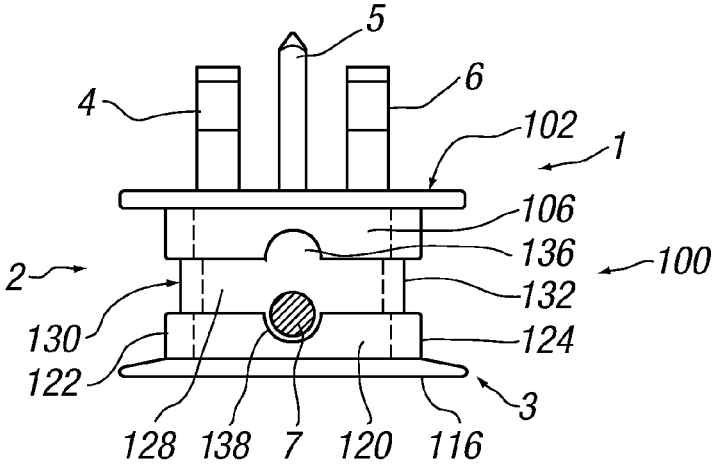

Referring to the figures, there is illustrated an electrical plug 100 of a type conforming to United Kingdom Standards for use with a mains power supply. The plug 100 has an electrical cable 7 associated therewith which is joined to an electrical appliance (not shown), such as an iron, hair straightening tongs and/or the like. The plug 100 is designed to engage in an electrical socket (not shown) of a type which can be connected, for example, to a 240V mains electricity supply.

More particularly, plug 100 includes an outer casing comprising a first part 1 (first electrical connection means) and a second part 3 (second electrical connection means). Each of first part 1 and second part 3 defines an inner cavity therein; electrical wiring and/or a fuse being located in said cavity as with a conventional plug arrangement.

First part 1 has a front face 102, top wall 104, base wall 106 and side walls 108, 110. Engagement means in the form of three pins 4, 5, 6 (one or more pins) protrude outwardly from front face 102 (engagement means to allow attachment of the apparatus to an electrical appliance). These pins also represent the live, earth and neutral electrical connections for the plug. Attachment means in the form of screws 112 are located through screw apertures 114 defined in front face 102 to allow first part 1 to be joined to second part 3 in use.

Second part 3 has a rear face 116, top wall 118, base wall 120 and side walls 122, 124. In addition, an inner housing 2 is associated with second part 3, although it is noted it could be associated with first part 1 if required. The inner housing 2 has top wall 126, base wall 128 and side walls 130, 132. The walls defining housing 2 has slightly smaller dimensions than the top wall, base wall and side walls 104, 106, 108, 110 of first part 1, thereby allowing walls 104-110 of first part 1 to be slidably movable over walls 126-132 of inner housing 2 in use (movement means). An aperture 134 is defined in base wall 128 of inner housing 2 for the location of electrical cable 7 therethrough in use. First part 1 has a hemispherical shaped recess 136 defined in base wall 106 and second part 3 has a hemispherical shaped recess 138 defined in base wall 120. The recesses 136, 138, when joined together, are substantially complementary in shape to aperture 134 to allow cable 7 to be located in aperture 134 without obstruction.

Internally, first part 1 has three electrical connections for connecting external pins 4, 5, 6 to three electrical connections provided internally of second part 3. The second part electrical connections communicate with electrical wires in electrical cable 7.

Figure 5:
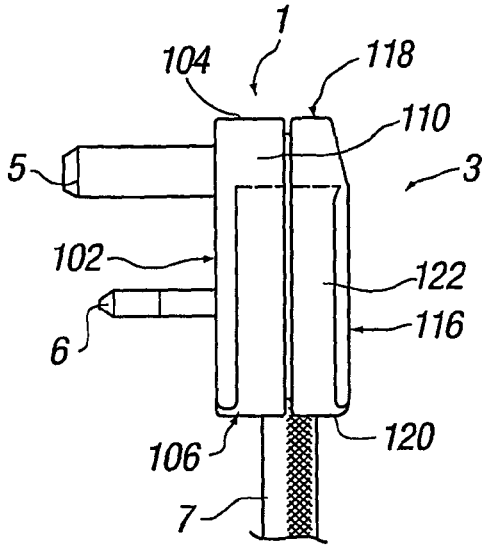
FIG. 5 illustrates a right side view of the electrical plug in FIGS. 1-4 in a first connected position.
Figure 6A:
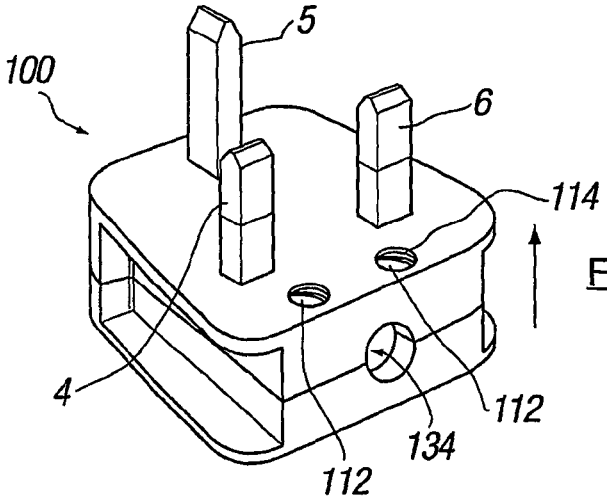
FIGS. 6*a* and 6*b* illustrate a perspective view of the plug in FIGS. 1-5 in a first connected position and a second disconnected position respectively.
Figure 6B:
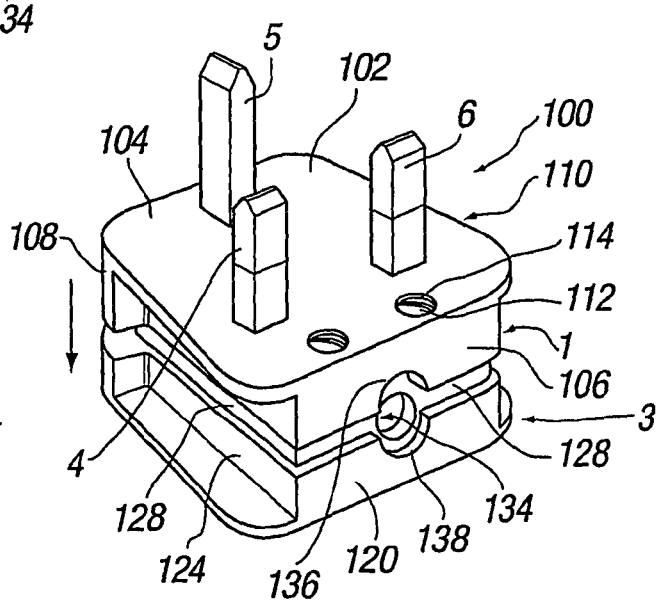

In accordance with the present invention, movement means are associated with first and second parts 1, 3 to allow slidable movement of first part 1 with respect to second part 3 following actuation of said movement means. More specifically, first and second parts 1, 3 are movable from a first connected position, as shown in FIGS. 5 and 6*a*, to a second disconnected position, as shown in FIGS. 1-4 and 6*b*.

In the first connected position, externally, side and end walls 104, 106, 108, 110 of first part 1 are adjacent and abut side and end walls 118, 120, 122, 124 of second part 3, inner housing 2 (sealing means) is located substantially inside the cavity defined in first part 1; internally, the second part electrical connections communicate with the first part electrical connections, thereby allowing the flow of electrical charge from an electrical socket in which plug 100 is located in use, through pins 4, 5, 6 to first part electrical connections, to the second part electrical connections and along electrical cable 7 to the appliance.

In the second disconnected position, externally, side and end walls 104, 106, 108, 110 of first part 1 are a spaced distance apart from end walls 118, 120, 122, 124 of second part 3, inner housing 2 is located partially outside the cavity defined in first part 1; internally, engagement between the second part electrical connections and the first part electrical connections is broken, thereby preventing the flow of electrical charge from an electrical socket in which plug 100 is located in use, through pins 4, 5, 6 to first part electrical connections, to the second part electrical connections and along electrical cable 7 to the appliance.

Movement of the first and second parts 1, 3 between the first and second positions typically takes place relatively slowly over a pre-determined time period following actuation of the movement means. As such, an automatic timing mechanism is produced which allows an electrical supply to be provided for the time taken for parts 1, 3 to move from the first to the second positions.

The movement means can include a mechanical, electrical and/or pneumatic mechanism. For example, a rod and piston pneumatic arrangement could be provided between the first and second parts or a spring mechanism. The timing of the mechanism could be altered if required by adjusting a switch, screw or other suitable adjustment means externally of the plug which changes, for example, the level of decompression of the spring.

During movement of the parts relative to each other, a seal is typically maintained between the first and second parts to prevent the ingress of water, dirt and/or the like and to prevent a user contacting the electrical connections. The seal can be provided via any suitable sealing means.

In use of the plug, a user locates plug 100 into a suitable electrical socket, such as a wall mounted three pin socket connected to a mains power supply, by pushing pins 4, 5, 6 into complementary apertures in the socket. Once the pins are engaged in the complementary apertures, the user continues to apply a pressure force against the plug to move second part 3 towards first part 1 to form the first connected position. When the user releases the pressure force off the plug, this automatically activates the movement mechanism causing gradual separation of the second part relative to the first part and sliding movement of inner housing 2 out of the interior cavity of first part 1 until the second disconnected position is reached. During the movement, a user typically is provided with an electrical supply to the appliance and the user can use the appliance until they have finished use or until the second disconnected position is reached, whichever happens sooner.

An override mechanism can be associated with the plug, such as means for maintaining engagement of the first and second parts 1,3 in the first connected position, if the user does not wish for the timer to be operated. This is advantageous if the user intends to use the appliance for a longer period of time than is allowed for by the timer mechanism.

The invention claimed is:

1. An electrical plug with timing mechanism, said plug including engagement means for attaching the plug to an electrical appliance or electrical socket in use, a first and second electrical connection means for allowing the flow of electrical charge, wherein the first and second electrical connection means can communicate with each other in use to allow the flow of electrical charge therebetween, and a movement means for allowing the relative movement of the first and/or second electrical connection means from a first position, wherein electrical charge can flow therebetween, to a second position, wherein the flow of electrical charge is prevented, the relative movement taking place over a pre-determined time period following actuation or on actuation of said movement means, the pre-determined time period providing the timing mechanism for the plug to allow an electricity supply to be provided for said pre-determined time period, wherein the first and second electrical connection means are associated with the first and second parts of the plug and said movement means allow relative movement of the first and/or second parts in use.

2. The plug according to claim 1 wherein the engagement means allows detachable attachment of the apparatus to an electrical appliance or electrical socket.

3. The plug according to claim 1 wherein the engagement means includes one or more electrical pins.

4. The plug according to claim 1 wherein the first and second electrical connection means are engaged or in electrical contact in the first position and a spaced distance apart and disengaged in the second position.

5. The plug according to claim 1 wherein the first and/or second parts and/or electrical connection means are arranged to undergo slidable relative movement.

6. The plug according to claim 1 wherein potential energy stored in the movement means is converted to kinetic energy on actuation of the movement means.

7. The plug according to claim 1 wherein the movement means move automatically following actuation of the same.

8. The plug according to claim 1 further comprising an adjustment means for adjusting the pre-determined time period for the movement means to move the first and/or second electrical connection means between the first and second positions, wherein said adjustment means are associated with the movement means.

9. The plug according to claim 1 wherein an electrical cable is associated with one of said first and second parts.

10. The plug according to claim 1 wherein the first and second parts form an outer casing or housing of a plug.

11. The plug according to claim 1 further comprising a sealing means for forming an interior cavity associated with the first and/or second parts that is substantially sealed in both the first and second positions.

12. The plug according to claim 1 wherein the pre-determined time period is sufficiently long to allow a user to perform at least one function associated with the apparatus or with an electrical item associated with the apparatus during the movement between the first and second positions.

13. The plug according to claim 1 wherein at least one of said parts includes an inner housing slidably located within an interior of the other of said parts.

14. A method of using electrical connection apparatus, said method including the steps of:

(a) engaging a plug according to claim 1 to an electrical appliance or electrical socket in use, (b) actuating the movement means to allow relative movement of the first and second electrical connection means between a first position, wherein electrical charge can flow there between, and a second position, wherein the flow of electrical charge is prevented, the relative movement taking place over a pre-determined time period following actuation or on actuation of said movement means, characterized in that the first and second electrical connection means are associated with first and second parts of the plug and said movement means allows relative movement of the first and/or second parts in use.

15. The plug according to claim 1 wherein the movement means are actuated by a user forcing the first and second parts and/or the first and second electrical connection means together to form the first position.

16. The plug according to claim 1 wherein the movement means are actuated by a user moving the first and second parts together to form the first position.

17. The plug according to claim 16 wherein a user is required to apply a first force to the first and/or second parts of the apparatus to engage the apparatus to a socket or appliance in use and a second force to the first and/or second parts of the apparatus to actuate the movement means.

18. The plug according to claim 17 wherein the first and second forces are required to be applied in substantially the same direction.

19. The plug according to claim 17 wherein the first and second forces are required to be applied in substantially different directions.

* * * * *